US008915313B2

(12) United States Patent
Haynes

(10) Patent No.: US 8,915,313 B2
(45) Date of Patent: Dec. 23, 2014

(54) HOLE BORING TOOL

(71) Applicant: Pesticide Delivery Systems, Inc., Reno, NV (US)

(72) Inventor: Robert W. Haynes, Morro Bay, CA (US)

(73) Assignee: Pesticide Delivery Systems, Inc., Reno, NV (US)

( * ) Notice: Subject to any disclaimer, the term of this patent is extended or adjusted under 35 U.S.C. 154(b) by 0 days.

(21) Appl. No.: 13/737,610

(22) Filed: Jan. 9, 2013

(65) Prior Publication Data

US 2014/0190102 A1 Jul. 10, 2014

(51) Int. Cl.
*E21B 10/32* (2006.01)
*E21B 7/00* (2006.01)
*E02D 27/32* (2006.01)

(52) U.S. Cl.
CPC .. *E21B 7/00* (2013.01); *E02D 27/32* (2013.01)
USPC ..... 175/273; 175/384

(58) Field of Classification Search
CPC ..... E21B 10/322; E21B 10/32; E21B 10/34; E21B 11/005; E21B 10/345; E21B 10/62; E21B 10/66; A01C 5/02; A01B 1/18
USPC ..... 175/263–292, 382–384, 398; 294/50.6, 294/50.7
See application file for complete search history.

(56) References Cited

U.S. PATENT DOCUMENTS 108,723 A * 10/1870 Myers ..... 294/50.5
816,236 A * 3/1906 Kline ..... 111/101
1,053,730 A * 2/1913 Jensen ..... 111/106
1,494,274 A * 5/1924 Morgan ..... 175/263
1,548,578 A * 8/1925 Blanchard ..... 175/269
1,804,850 A * 5/1931 Campbell et al. ..... 175/271
1,888,929 A * 11/1932 McDowell ..... 294/50.8
2,069,482 A * 2/1937 Seay ..... 175/269
2,177,721 A * 10/1939 Johnson et al. ..... 175/243
2,230,498 A * 2/1941 Loos et al. ..... 294/50.8
2,599,060 A * 6/1952 Kammerer ..... 175/290
2,654,626 A * 10/1953 Rice ..... 294/50.8
2,710,765 A * 6/1955 Arens ..... 294/50.6
2,758,819 A * 8/1956 Kammerer, Jr. ..... 175/267
2,799,479 A * 7/1957 Kammerer ..... 175/268
2,814,463 A * 11/1957 Kammerer, Jr. ..... 175/267
3,567,264 A * 3/1971 Baber ..... 294/50.7
4,179,147 A * 12/1979 Mendenhall ..... 294/50.7
4,694,760 A * 9/1987 Camp ..... 111/92
4,961,471 A 10/1990 Ovens
4,986,373 A 1/1991 Charland et al.
5,141,063 A * 8/1992 Quesenbury ..... 175/267
5,320,363 A * 6/1994 Burnham ..... 294/50.8
5,560,440 A * 10/1996 Tibbitts ..... 175/384
6,009,961 A * 1/2000 Pietrobelli et al. ..... 175/269
6,131,675 A * 10/2000 Anderson ..... 175/268
6,227,317 B1 5/2001 Severns
7,293,616 B2 * 11/2007 Tulloch ..... 175/269
7,347,276 B2 3/2008 Basek
7,673,698 B2 3/2010 Walker
2004/0124011 A1 * 7/2004 Gledhill et al. ..... 175/57

* cited by examiner

*Primary Examiner* — Blake Michener

(74) *Attorney, Agent, or Firm* — Roberts Mlotkowski Safran & Cole, P.C.

(57) ABSTRACT

A boring tool for digging holes having a vertical shaft of a first diameter extending from the soil surface to a suitable subsurface distance, and a void of a second diameter, larger than that of the first diameter, at the bottom, subsurface distance.

13 Claims, 5 Drawing Sheets

HOLE BORING TOOL

FIELD

This invention relates to a new tool for boring holes, particularly holes suitable for construction footings.

BACKGROUND

When digging holes for construction footings, in order to support a sufficient load, it is necessary to dig a hole of a large diameter, pour the footing with a suitable footing material, such as concrete, up to a certain level within the hole, and after the footing material has hardened or set, to back-fill the hole to form a smaller diameter shaft to the soil surface. Conventionally, this is accomplished by inserting and centering a tube of the desired smaller diameter into the hole, and back-filling the hole volume around the tube with earth or rocks or both.

Many types of post hole diggers are known. Auger-type diggers are provided with a screw that is advanced into the ground, such as the motorized auger shown by Ovens (U.S. Pat. No. 4,961,471). Alternatively, a boring implement can be secured to an end of a post for insertion into the ground. The post is rotated to advance the implement to the desired depth, aided by a stream of water directed into the borehole (Charland, et al., U.S. Pat. No. 4,986,373). The implement is left in the ground after the post has been positioned.

Manual post hole diggers are perhaps the most common type being sold today. The familiar "clamshell" digger consists of four main parts: two long pole-handles and two clamshell digging cups connected to the handles. The handles are moved together to separate the cups and apart to bring the cups together. Digging is accomplished by plunging the digger into the ground with the handles together, followed by spreading the handles apart to force the cups together to grip a quantity of soil. The digger is pulled out, handles still held apart, and the load is then dumped off to the side. The process is repeated until the hole is the desired depth.

However, with this type of digger a principal problem is that as the hole is dug deeper, the handles cannot be spread apart sufficiently far to grip the soil unless the diameter of the top of the hole is made progressively larger—otherwise, the handles will bind with the top edge of the hole. This type of digger requires time and effort for the removal of additional soil, and provides a less firm foundation for a post set into the hole when the loosened soil is used as fill. Likewise, another drawback is that this type of digging tool is limited to making constant diameter post holes.

U.S. Pat. No. 5,320,363 to Burnham discloses a post hole digger having a bracket plate, a first shaft assembly and a second shaft assembly, each shaft assembly with a first end and a second end. The first ends of the shaft assemblies are connected to the bracket plate. A pair of handles are pivotally attached to the first ends, and a pair of digging blades are pivotally attached to the second ends of the shaft assemblies. As the handles are rotated with respect to one another, the first shaft assembly moves axially with respect to the second shaft assembly to open and close the digging blades. The shaft assemblies are held in spaced relation to one another during operation of the digger so that the hole has an approximately constant diameter. A detent mechanism is provided for indicating when the digging blades are oriented approximately parallel to one another for insertion into the ground. Extension rods increase the operating length of the shafts to allow digging deeper holes.

U.S. Pat. No. 6,227,317 to Severns discloses a garden auger having an auger blade with a substantially rectangular body section for use with a drill motor. The preferred auger body includes toed-in wings for rapidly clearing earth from the created hole and cutters formed at one end of the auger blade.

U.S. Pat. No. 7,347,276 to Basek discloses a manual garden tool for tilling or breaking up surface soil, having an elongate shaft with an actuator rotatably mounted at its lower end, tine(s) mounted to the actuator, and a cam surface at the lower end of the shaft in contact with a surface of each tine such that, as the actuator is rotated between the first and second positions, the upper portion of each tine rotates with respect to the actuator and the lower portion of the tine moves between extended and contracted positions. The actuator and tines are locked against rotation when the tines are in either position, with the tines being locked against movement by being seated in troughs of a spilot plate. The actuator and tines can be unlocked and moved up the shaft to provide clearance past seat walls for the tines to move between the extended and contracted positions.

U.S. Pat. No. 7,673,698 to Walker discloses a gardening hand tool for digging holes which comprises a pair of shovel blades aligned parallel to each other and are pivotally attached to the bottom of a shaft member. A handle is attached to the upper end of a shaft member and is pivotally connected to the shovel blades.

It would be advantageous if a digging tool could drill or bore a hole having a larger diameter at the bottom thereof, and a smaller diameter shaft above the bottom portion which would not need to be back-filled in the conventional manner.

SUMMARY

In one aspect, the invention resides in a hole boring tool having at least one laterally extendable cutting blade at a lower portion thereof, structured and arranged to bore a hole with a larger diameter void at the bottom than at the top of the tool.

In another embodiment, the invention is directed to a hole boring tool having an axis of rotation, comprising: an inverted hollow cone having inner and outer surfaces, an axial tip located at a lower, soil penetrating portion of the tool, and an upper terminus; a drive frame attached to said upper terminus of said inverted hollow cone, comprising: (i) a lower portion having two vertical side plates with upper and lower ends, the lower ends of said vertical side plates connected to opposing sides of said cone upper terminus, (ii) a horizontal plate connecting the upper ends of said side plates, with an axial hole in said horizontal plate, and (iii) a hollow outer shaft having upper and lower ends and an inner diameter, the lower end of said hollow outer shaft being connected to the upper surface of said horizontal plate, and said inner diameter communicating with said axial hole in said horizontal plate; an axial inner shaft having upper and lower ends, the lower end pivotally and centrally disposed within the tip of the inner surface of said cone, extending axially through said drive frame and hollow outer shaft, and having upper and lower pivot arms attached to a lower portion of said inner shaft within said drive frame; at least one laterally extendable blade assembly having a pivot end and a cutting end, the pivot end pivotally attached between said upper and lower pivot arms; and an indexing assembly, comprising: (iv) a pilot plate having upper and lower surfaces, (v) an indexing plate having upper and lower surfaces, disposed axially adjacent to said pilot plate, and locking means which coact with said pilot plate and said indexing plate to control relative axial rotation between them, wherein the lower surface of one of said plates is connected to the upper end of said inner shaft, and the lower surface of the other of said plates is connected to the upper end of said hollow outer shaft such that the inner diameter thereof communicates with an axial hole in the plate connected thereto, said plates being rotatably moveable relative to each other on the axis of rotation.

In another embodiment, the invention is directed to a method for boring a hole in soil, comprising placing a hole boring tool having an axis of rotation onto a surface of the soil, applying a vertical down force on said tool and rotating said tool while applying said down force to force said tool into the soil, said hole boring tool comprising at least one laterally extendable cutting blade at a lower portion thereof, structured and arranged to bore a hole with a larger diameter void at the bottom than at the top of the tool.

Another embodiment of the present invention is directed to a construction footing comprising a bore hole in soil of a first diameter extending from a surface of the soil to a predetermined depth, and a subsurface void of a second diameter, larger than said first diameter, below said bore hole and filled with a suitable footing composition.

BRIEF DESCRIPTION OF THE DRAWINGS

The following figures are provided for purposes of illustration only and should not be considered to limit the claims in any way. The numbering of elements is consistent throughout the figures, such that like numbering identifies like structures.

DETAILED DESCRIPTION OF THE EMBODIMENTS

Figure 1:
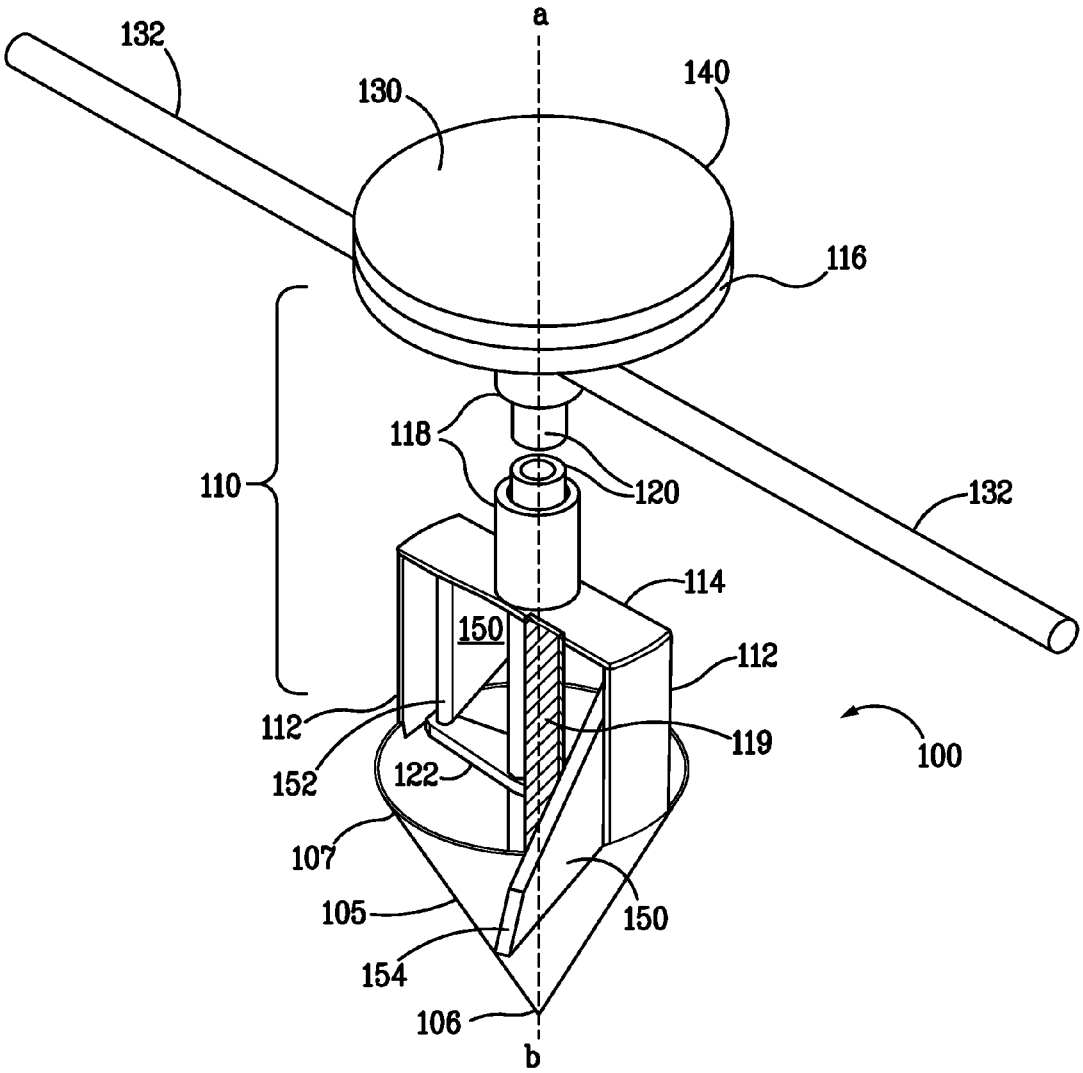
FIG. 1 is an overall plan view of one embodiment of the boring tool of the present invention.

Described herein is a unique boring tool for digging holes for construction footings, water wells, petroleum wells, natural gas wells or the like, which have a vertical shaft of a first diameter extending from the soil surface to a suitable subsurface distance, and a void of a second diameter, larger than that of the first diameter, at the bottom, subsurface distance.

The boring tool of the present invention has multiple advantages in comparison to prior art boring and/or digging devices. For example, most outside deck footings, house/cottage footings, porch footings and the like are typically six inch diameter holes dug to between one and six feet into the ground (depending on local building codes). Once dug, the holes are filled with concrete and the structures are then built on top of the footings.

It is well-known in the art that it is advantageous to distribute the weight of the overlying structure over a large a footing diameter, so as to limit the overall weight at the footing to a relatively low level on a per unit square area basis, since the amount of weight a footing can carry is a function of the soil conditions and the surface area of the bottom of the footing. For example, for a soil that can bear a 50 lb/in$^2$ load, a footing with a six inch diameter will support 1,400 pounds, whereas in the same soil a fifteen inch diameter footing will support 8,850 pounds, 6.3 times the load of the smaller diameter footing.

However, merely digging larger diameter footing holes has several drawbacks. First, a great deal more soil must be removed from a larger diameter hole than from a smaller diameter hole. For example, a six inch diameter hole 48 inches deep requires removal of 0.7 cubic feet of soil, whereas a 15 inch diameter hole dug to the same depth requires 4.9 cubic feet of soil to be removed. Removing this extra soil for the larger diameter footings requires about six times the labor as compared to the smaller diameter hole. Additionally, in order to limit the amount and therefore cost of concrete necessary in the larger diameter footing, it is conventional to first pour the settable footing material (concrete), and when it has hardened, to put a central, tubular form into the hole of a smaller diameter than the hole but sufficient to support the intended overlying structure, and to then back-fill around the tubular form with soil and/or rocks removed from the hole. Beside the additional labor required to back-fill the hole, the back-filled material must be compacted to an extent to avoid lateral movement of the support column placed or built into the central hole.

The presently claimed invention eliminates the digging of a larger diameter hole and back-filling of that hole by boring a hole of a first diameter to the desired subsurface depth, and widening that hole to a second, larger diameter at the bottom of the hole, without requiring subsequent back-filling and compaction.

For purposes of definition, the terms "axial" and "axially" are meant to indicate that the component so-described is coincident with the axis of rotation of the tool.

Advantageously, the hole boring tool of the present invention has at least one laterally extendable cutting blade at a lower portion thereof, structured and arranged to bore a hole with a larger diameter void at the bottom than at the top of the tool. The lateral extension of the cutting blade can be controlled from the top of the tool, and the cutting blade is retractable within the diameter of the tool, such that upon initial soil penetration, the tool is at its minimum diameter facilitating penetration of the tool into the soil. Upon reaching a desired depth of penetration into the soil, or in some cases rock, the cutting blade can be laterally extended varying distances away from the axis of the tool while the tool is rotated, so as to cut an increasingly larger diameter hole, preferably also having a greatly increased volume, at the bottom of the shaft created by the boring operation. The cutting blade is then retracted within the confines of the tool to permit removal from the hole.

The cutting blade(s) are manufactured from a hardened material, which can comprise a metal such as iron or steel, and can further comprise cutting portions disposed on the surfaces or edges of the blade(s) including metal carbides, such as silicon carbide or tungsten carbide, or even diamond. These extremely hard materials find use especially when cutting through and into rock, such as when the inventive tool is used for drilling water, petroleum or natural gas wells. In such use, it can be advantageous if the extended cutting blade(s) is disposed at an angle to the axis of the hole or the drill string, such that the blade(s) cut through the soil or stone at an angle with a leading cutting edge, rather than with the entire face of the blade. Of course, the presently disclosed tool can be machine driven.

In a preferred embodiment, the hole boring tool of the present invention comprises at least two cutting blades disposed on opposite sides of the lower portion of said tool, which itself can comprise an inverted hollow cone and said cutting blades can be retracted within a diameter equal to that of an upper terminus of said cone, during the initial drilling operation, and laterally extended from said diameter once a predetermined depth is reached so as to create the larger diameter/volume void at the bottom of the bore hole.

The present invention may find particularly advantageous use in the exploration and production of petroleum and or natural gas. Currently a great deal of natural gas exploration and production is being conducted by a "fracking" process, wherein one or more holes are bored into the ground and high pressure is applied to subsurface rock layers in order to create large fractures therein. Natural gas contained in the subsurface rock can migrate into these fractures and be recovered. However, the fracking process has been criticized for a variety of reasons, including the nature of liquids used in applying the high "fracking" pressures, and for the relatively uncontrolled extent and directions in which the underground fractures are created.

In contrast, use of the presently disclosed bore hole tool will result in boring a hole with complete control over direction, depth and the like, as well as one having a considerable void at the bottom thereof in which water, petroleum or natural gas can collect from the surrounding rock and be recovered. Of course, the presently disclosed tool can be used at the end of the drilling process, such that a conventional drill bit is used on the drill string to bore to the desired depth, and then replaced with the presently disclosed tool, which is then used to create a large void at the bottom of the well.

Figure 2:
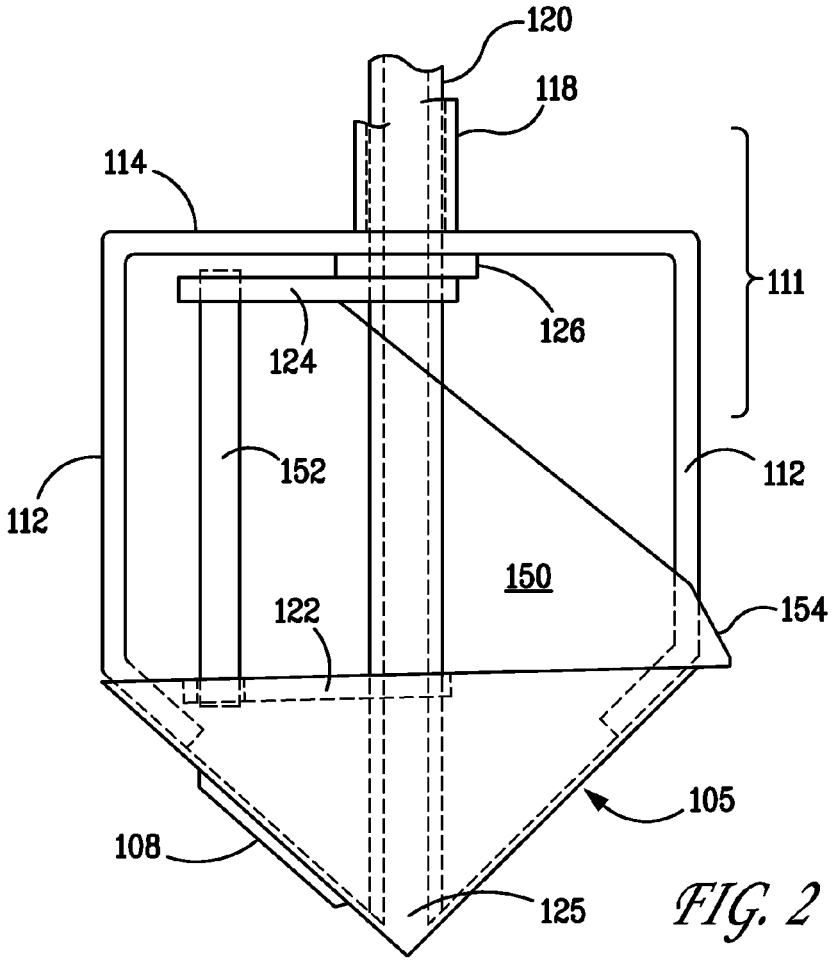
FIG. 2 is a cross-sectional side view of the lower portion of the boring tool, especially the drive frame and associated elements thereof.

Referring now to FIGS. 1 and 2, in one embodiment the inventive boring tool (100) has an axis of rotation around line (a-b), a lower, soil penetrating portion and an upper control portion. The lower portion of the tool comprises a soil penetrating cone (105) having an axial tip (106) and an upper terminus of the cone (107), where the cone is connected to a drive frame (110). The drive frame comprises two vertical side plates (112) connected to the upper terminus of the cone (107), such as by welding the vertical side plates (112) to the inner surface of the cone (105). The drive frame further comprises a horizontal plate (114) extending between and connected to the tops of said vertical side plates (112), and includes an axial hollow outer shaft (118) connected to the horizontal plate (114) of the drive frame. The inner diameter (FIG. 4, $D_1$) of the hollow outer shaft (118) communicates with an axial hole of similar diameter centered in the horizontal plate (114). The lower portion of the tool is connected to the upper portion by hollow outer shaft (118), the upper portion of which is connected to the lower surface of an indexing plate (116), which can be in the form of a disk, which has one or more optional handles (132) extending therefrom. In an advantageous but optional embodiment, the drive frame has a vertical brace (119) extending from an interior surface of the cone to horizontal plate (114).

The boring tool further comprises a pivoting portion within the tool to control blade assembly (150), which acts to form the lower, larger diameter portion of the footing hole. The pivoting portion comprises a pilot plate (130), which can be in the form of a disk, having an axially connected inner shaft (120) extending from the lower surface thereof, through hollow outer shaft (118) and horizontal plate (114), down to the interior of tip (106) of the cone (105), where the inner shaft (120), which can be hollow, coacts with a pivot assembly (125) to permit axial pivoting of the inner shaft within the cone tip (106) and ultimately throughout the boring tool (100). Connected to the inner shaft are lower and upper pivot arms (122) and (124), disposed within the lower portion (111) of drive frame (110). Top pivot arm (124) can optionally be displaced from horizontal plate (114) by a bearing (126). The outer portions of these pivot arms are provided with holes to support a pivot end (152) of at least one blade assembly (150), which has a cutting end (154), opposite said pivot end. Preferably, the device includes at least two blade assemblies (150) pivotally connected to pivot arms (122) and (124) which extend from and are connected to inner shaft (120), such as by welding or the like. Optionally, the outer surface of cone (105) can be provided with a scraping ridge (108) or other such digging, scraping or boring apparatuses for soil displacement to enhance loosening and removal of soil.

Cutting end (154) can be enhanced by coating with or otherwise attaching extremely hard cutting materials on portions thereof, such as metal carbides or diamond chips. Likewise, under certain circumstances all or portions of bottom edge (155) of blade assembly (150) can be configured similarly to comprise these hardened materials, especially when blade assembly (150) is angled relative to axis a-b, such that bottom edge (155) is configured as a leading cutting edge.

Importantly, the pivoting pilot plate (130) coacts with indexing plate (116) through disengageable locking means (140), described in more detail below, which when engaged acts to lock pilot plate (130) and indexing plate (116) against relative axial rotational movement between them. When disengaged, the locking means permits such relative axial rotational movement between pilot plate (130) and indexing plate (116), which acts to pivot and thereby extend blade assembly (150) outside of drive frame (110) and into the surrounding subsurface soil.

Figure 3:
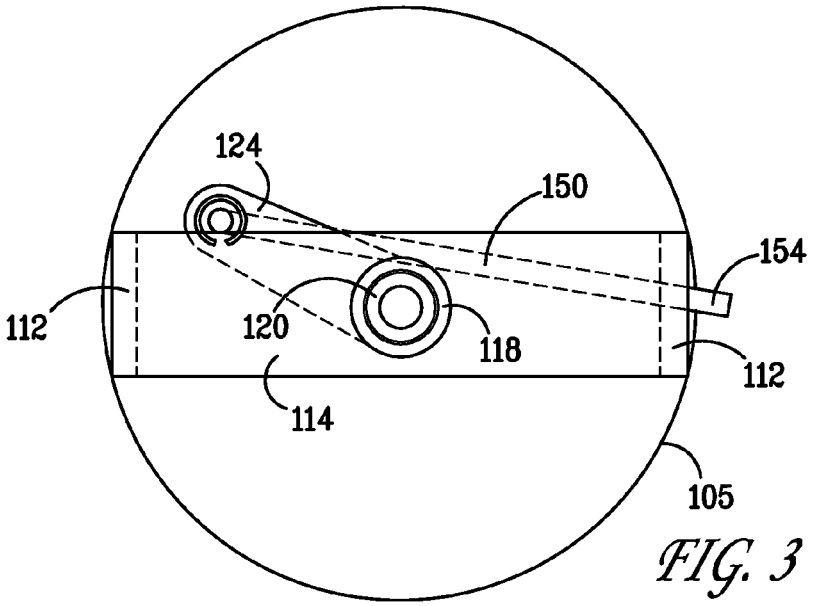
FIG. 3 is a top view of the apparatus in FIG. 2.

The pivoting action of the device will be more readily understood be reference to FIG. 3, which is a top view of the lower portion of boring tool (100). According to this figure, clockwise rotation of inner shaft (120) relative to hollow outer shaft (118) acts to rotate pivot arm (124), thus forcing blade assembly (150) in a lateral direction relative to the drive frame and the upper terminus of cone (105), so as to extend the cutting end (154) of blade assembly (150) into the surrounding subsurface soil. The extent to which blade assembly (150) is forced into the surrounding soil is controlled by rotational coaction between indexing plate (116) and pilot plate (130) through locking means (140), such that blade assembly (150) and its cutting end (154) can be incrementally extended into the surrounding soil by axial rotation of pilot plate (130) relative to indexing plate (116), followed by engaging locking means (140) to lock pilot plate (130) and indexing plate (116) against further rotational movement, and then rotating the entire boring tool (100), so as to remove subsurface soil and to circumscribe a larger diameter subsurface void with blade assembly (150).

Figure 4:
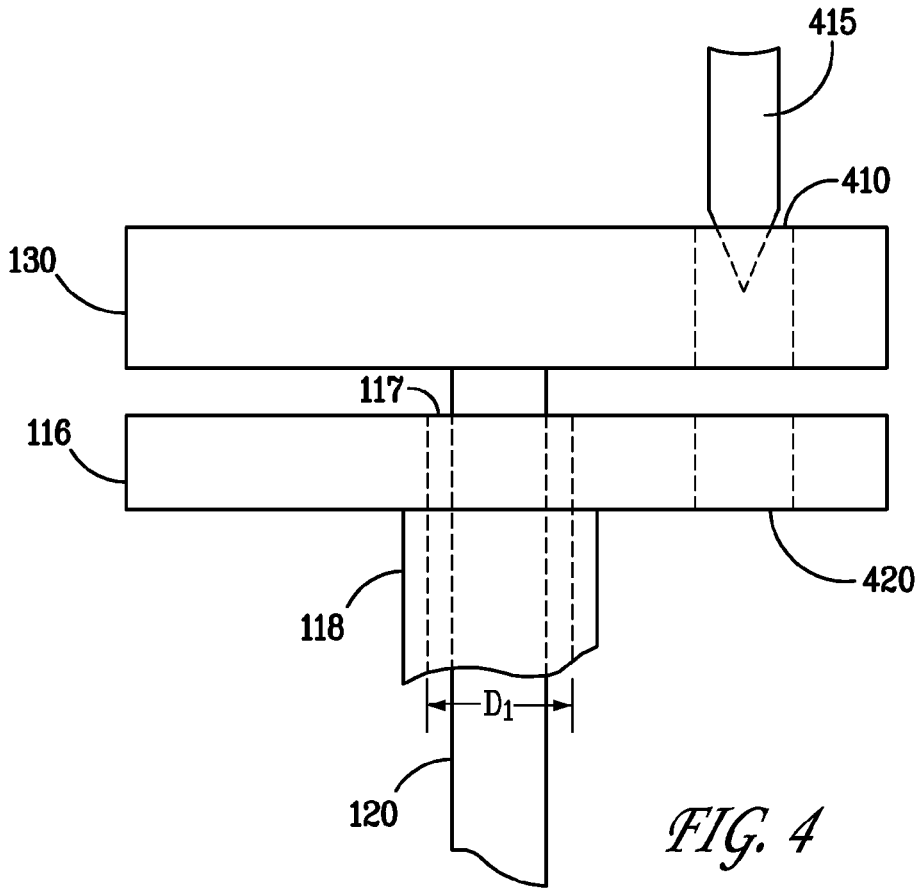
FIG. 4 is a cross-sectional side view of the upper portion of the boring tool of the present invention.
Figure 5:
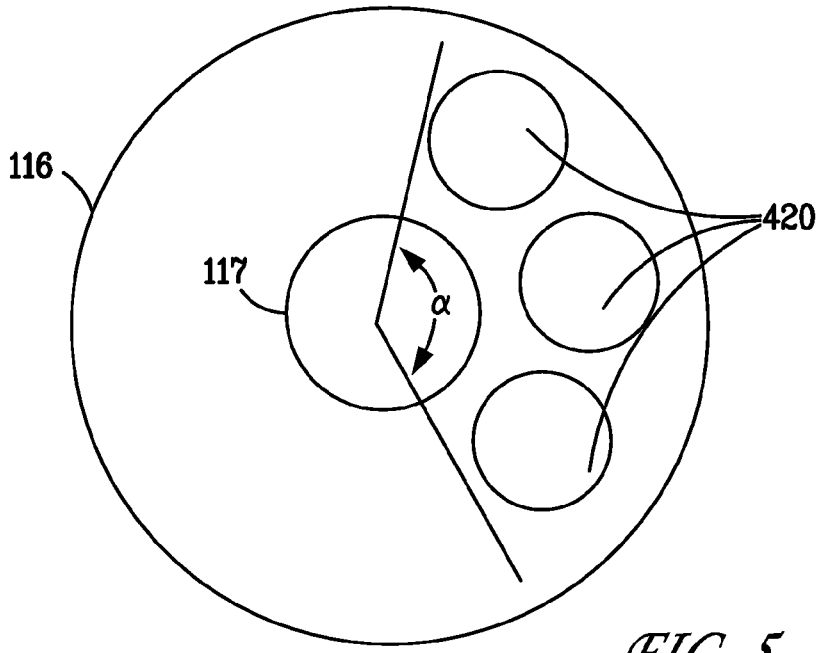
FIG. 5 is a top view of an embodiment of the indexing plate of the boring tool of the present invention.

FIGS. 4 and 5 illustrate a simple example of locking means (140), which comprises a pilot hole (410) extending through pilot plate (130), radially displaced a particular distance from the axial connection of inner shaft (120) to the lower surface of pilot plate (130), vertically aligned with a series of indexing holes (420) in indexing plate (116), and a pilot pin (415) which when engaged extends through pilot hole (410) and into or through one of indexing holes (420), to lock plates (130) and (116) against relative axial rotational movement between them. FIG. 5 depicts the upper surface of indexing plate (116) having a series of indexing holes (420) disposed within a preselected angle ($\alpha$) of and radially displaced from the axial hole (117) in the indexing plate. The radial displacement of pilot hole (410) from the pivotal axis of pilot plate (130) is the same distance as that of each of indexing holes (420) from the pivotal axis of indexing plate (116), such that upon rotation of pilot plate (130) relative to indexing plate (116), pilot hole (410) will align with each of indexing holes (420), permitting insertion and removal of pilot pin (415) through pilot plate (130) and into indexing plate (116).

Indexing holes (420) can be configured either to extend through the entirety of indexing plate (116), or only to extend partially into indexing plate (116) to a depth effective to achieve locking of plates (130) and (116) relative to each other. Further, while pilot pin (415) is depicted to have a conical lower end, it should be understood that the lower end of pilot pin (415) could be configured to have any suitable cross-section, such as a rounded lower end or even a flat lower end. Likewise, it should be recognized that pilot pin (415) can be configured in its simplest embodiment to be manually inserted and extracted, or could optionally be configured to be inserted and extracted by automated means, such as with an electrical solenoid or with a pneumatically or hydraulically activated piston.

Likewise, the locations of pilot plate (130) and indexing plate (116) can be reversed, such that indexing plate (116) is disposed axially above pilot plate (130).

Figure 6A:
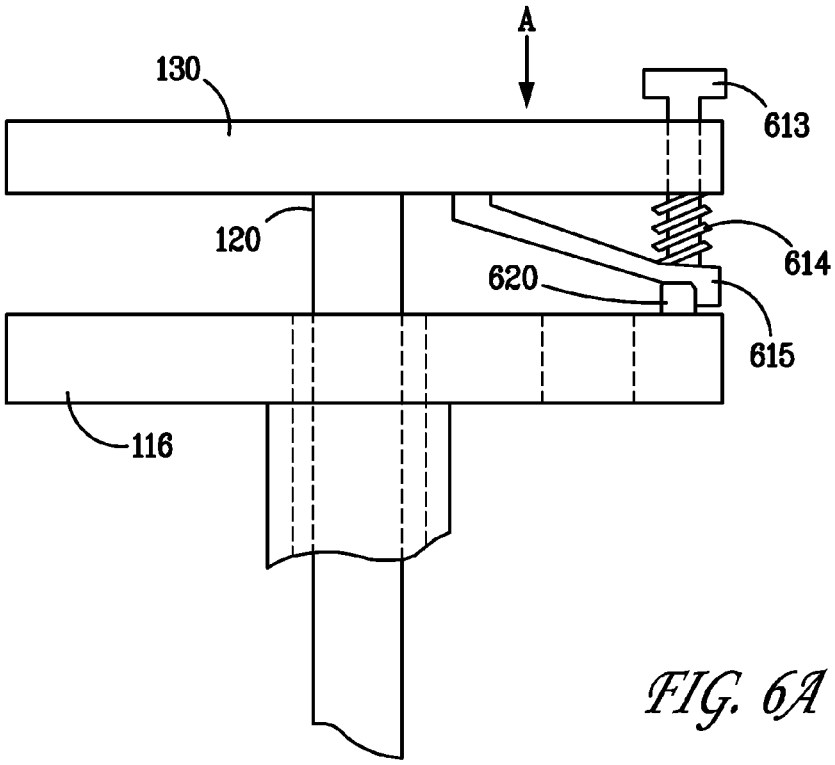
FIGS. 6A-6C depict an alternative embodiment of the indexing apparatus of the boring tool of the present invention.
Figure 6B:
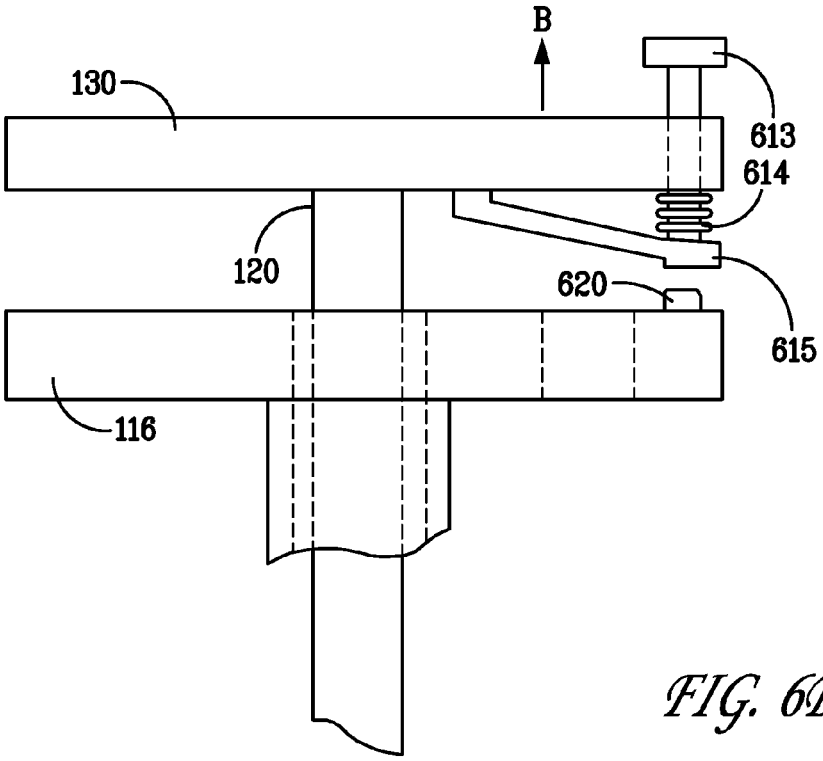
Figure 6C:
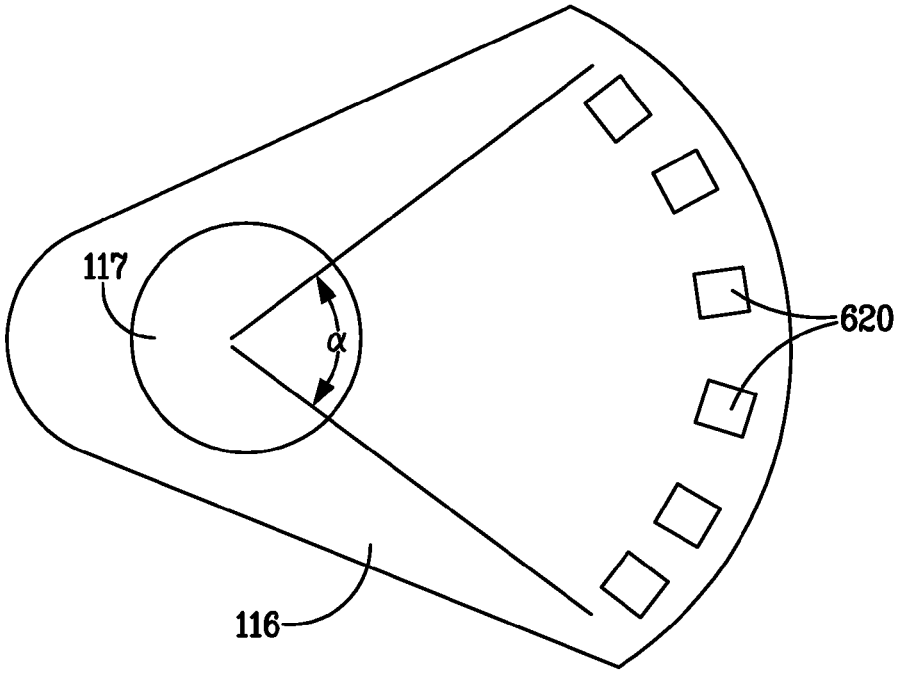

FIGS. 6A-6C illustrate an alternative embodiment of locking means (140), which comprises a flexible pilot tooth assembly (613), disposed at one end of pilot plate (130), having at the opposite end thereof a pilot tooth (615), configured to engage a series of indexing teeth (620) disposed on the upper surface of indexing plate (116). This series of indexing teeth (620) is best seen in FIG. 6C, wherein indexing plate (116) is depicted in an alternate embodiment as an oblong plate rather than as a disk, and the indexing teeth (620) are disposed between preselected angle ($\alpha$) on the upper surface of indexing plate (116). A lower portion of pilot tooth assembly (613) is connected to pilot tooth (615), which is biased with tension into an engaged position, such as wherein the lower portion of said pilot tooth assembly (613) is surrounded with a compression spring (614), such that when spring (614) is in its normal, expanded state, pilot tooth (615) is biased downwardly in direction (A) (FIG. 6A) to engage between any two of indexing teeth (620) on the upper surface of indexing plate (116), locking plates (130) and (116) against relative rotation between them. Likewise, pilot tooth assembly (613) can be disengaged in direction (B) (FIG. 6B) by an operator pulling up on the top portion of pilot tooth assembly (613) and compressing spring (614), such that pilot tooth (615) is withdrawn from between indexing teeth (620) to permit relative rotation between plates (130) and (116).

Again, those skilled in the art will recognize that the locking means according to this embodiment can be modified or varied in a number of ways, such as for example wherein pilot tooth (615) is attached at its midpoint to pilot plate (130) and articulated with a pivot, such that pilot tooth assembly (613) can be disposed on the end opposite pilot tooth (615), and activated to disengage the pilot tooth (615) from the indexing teeth (620) by pushing the pilot tooth assembly (613) in a downward direction. Likewise, the locking means could be reconfigured to use a compression spring (614) which is in a normally compressed state, and is activated to disengage the locking means by pulling the spring into an extended direction. Likewise, the indexing teeth (620) could be modified to be a series of detents within the upper surface of indexing plate (116), into which pilot tooth (615) extends to engage the locking means. Further, the combination pilot tooth assembly (613) and pilot tooth (615) could be configured to be activated electrically, such as by a solenoid, or with a pneumatically or hydraulically activated piston.

In another embodiment the present invention is directed to a process for boring or drilling a hole in soil, by placing the hole boring tool, described above, onto a surface of the soil, applying a vertical down force on said tool and rotating said tool while applying said down force so as to force the tool into the soil to a preselected depth, thereby boring a hole into the soil having a first diameter corresponding to that of the upper terminus of the cone. During such boring process, the pilot plate assembly and indexing plate are rotationally aligned and locked, such that the cutting end of the blade assembly is maintained substantially within the drive frame of the tool.

Subsequently, after reaching a predetermined depth within said soil, the process further comprises disengaging the locking means to permit relative rotation between the pilot plate and the indexing plate, rotating the pilot plate assembly relative to said indexing plate so as to force the cutting end of the blade assembly laterally outward from said drive frame, engaging said locking means so as to lock the pilot plate assembly and indexing plate against said relative axial rotation, and rotating the digging tool about its axis of rotation, such that the cutting end or edge of said blade assembly increases the subsurface diameter of said hole in the soil, relative to said first diameter. This portion of the process can be repeated so as to further extend the cutting end or edge of the blade assembly into the subsurface soil so as to form successively larger subsurface diameter voids.

In an advantageous embodiment, the hole boring tool is withdrawn during the boring process, and soil which has collected within the inverted cone is removed.

Figure 7:
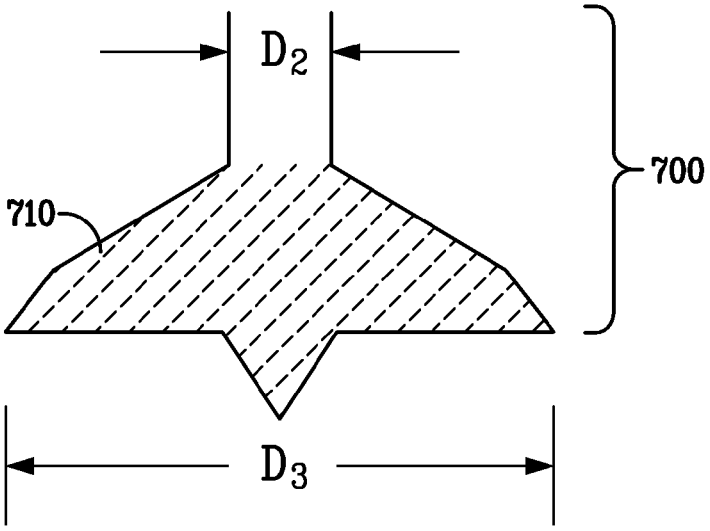
FIG. 7 is a side view of a footing hole according to the present invention.

Another embodiment of the present invention is illustrated in FIG. 7, which depicts a construction footing comprising a bore hole (700) of a first diameter ($D_2$) in soil, extending from a surface of the soil to a predetermined depth, and a subsurface void of a second diameter ($D_3$), larger than said first diameter, below said bore hole and filled with a suitable footing composition (710). Advantageously, the bore hole is not back-filled to diameter ($D_2$).

While the present invention has been described and illustrated by reference to particular embodiments, those of ordinary skill in the art will appreciate that the invention lends itself to variations not necessarily illustrated herein. For this reason, reference should be made solely to the appended claims for purposes of determining the true scope of the present invention.

What is claimed is:

1. A hole boring tool having an axis of rotation, comprising:

an inverted hollow cone having inner and outer surfaces, an axial tip located at a lower, soil penetrating portion of the tool, and an upper terminus;

a drive frame attached to said upper terminus of said inverted hollow cone, comprising:

a lower portion having two vertical side plates with upper and lower ends, the lower ends of said vertical side plates connected to opposing sides of said cone upper terminus, a horizontal plate connecting the upper ends of said side plates, with an axial hole in said horizontal plate, and a hollow outer shaft having upper and lower ends and an inner diameter, the lower end of said hollow outer shaft being connected to the upper surface of said horizontal plate, and said inner diameter communicating with said axial hole in said horizontal plate;

an axial inner shaft having upper and lower ends, the lower end pivotally and centrally disposed within the tip of the inner surface of said cone, extending axially through said drive frame and hollow outer shaft, and having upper and lower pivot arms attached to a lower portion of said inner shaft within said drive frame;

at least one laterally extendable blade assembly having a pivot end and a cutting end, the pivot end pivotally attached between said upper and lower pivot arms; and an indexing assembly, comprising:

a pilot plate having upper and lower surfaces, an indexing plate having upper and lower surfaces, disposed axially adjacent to said pilot plate, and locking means which coact with said pilot plate and said indexing plate to control relative axial rotation between them, wherein the lower surface of one of said plates of said indexing assembly is connected to the upper end of said inner shaft, and the lower surface of the other of said plates of said indexing assembly is connected to the upper end of said hollow outer shaft such that the inner diameter thereof communicates with an axial hole in the plate connected thereto, said plates being rotatably moveable relative to each other on the axis of rotation.

2. The hole boring tool of claim 1, wherein the locking means comprises:

a plurality of indexing holes disposed on a surface of said indexing plate, radially outward at a distance from the axis of rotation and within a selected angle relative to the axis, a pilot hole disposed on a surface of said pilot plate adjacent to said index plate, radially outward at said same distance from the axis of rotation on said pilot plate, and a moveable pilot pin configured to extend between said pilot hole and into said indexing holes.

3. The hole boring tool of claim 2, wherein when said pilot pin is disposed through said pilot hole in said pilot plate and into a first of said indexing holes of said indexing plate, the cutting end of said blade assembly is contained substantially within said drive frame and between a vertical side plate and a vertical brace disposed between the upper terminus of said inverted cone and said horizontal plate of said drive frame.

4. The hole boring tool of claim 2, wherein the indexing holes in said indexing plate are configured such that rotating said pilot plate relative to said indexing plate and placing said pilot pin through said pilot hole in said pilot plate and sequentially into said radially disposed indexing holes acts to pivot the blade assembly and sequentially force the cutting end of said blade assembly further outside of said drive frame.

5. The hole boring tool of claim 1, wherein the locking means comprises a pilot tooth assembly on said pilot plate, said pilot tooth assembly having a pilot tooth disposed at one end thereof and engaged with a series of indexing teeth disposed on a surface adjacent to said indexing plate, said locking means having a control on said pilot plate to permit locking said pilot plate and said indexing plate against relative rotation, and to permit disengagement of said pilot tooth from said indexing teeth, to allow selective rotation of said pilot plate relative to said indexing plate.

6. The hole boring tool of claim 1, further comprising digging, scraping or boring apparatuses disposed on the outer surface of said inverted hollow cone.

7. The hole boring tool of claim 1, further comprising at least one vertically disposed brace between the upper terminus of said inverted cone and said horizontal plate of said drive frame, disposed opposite the blade assembly from said vertical side plates.

8. The hole boring tool of claim 1, wherein said indexing plate is a disk.

9. The hole boring tool of claim 1, wherein said pilot plate is a disk.

10. The hole boring tool of claim 1, wherein said inner shaft is hollow.

11. The hole boring tool of claim 1, further comprising a second laterally extendable blade assembly attached between said upper and lower pivot arms, wherein said pivot arms extend from either side of said inner shaft.

12. The hole boring tool of claim 1, wherein said indexing plate is attached to said hollow outer shaft, and the pilot plate is attached to said axial inner shaft and disposed above the indexing plate.

13. The hole boring tool of claim 1, wherein upon rotation of said pilot plate relative to said indexing plate, the blade assembly pivots so as to move the cutting end of said blade assembly laterally and outside of said drive frame.

* * * * *